US010705464B2

(12) United States Patent
Nagata

(10) Patent No.: US 10,705,464 B2
(45) Date of Patent: Jul. 7, 2020

(54) IMAGE FORMING APPARATUS, IMAGE FORMING METHOD, AND STORAGE MEDIUM

(71) Applicant: Konica Minolta, Inc., Chiyoda-ku, Tokyo (JP)

(72) Inventor: Satoru Nagata, Musashino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/505,214

(22) Filed: Jul. 8, 2019

(65) Prior Publication Data

US 2020/0033780 A1 Jan. 30, 2020

(30) Foreign Application Priority Data

Jul. 24, 2018 (JP) ..... 2018-138097

(51) Int. Cl.
*G03G 15/00* (2006.01)
*G03G 15/095* (2006.01)

(52) U.S. Cl.
CPC ..... *G03G 15/502* (2013.01); *G03G 15/095* (2013.01)

(58) Field of Classification Search
CPC ..... G03G 15/502; G03G 15/095
See application file for complete search history.

(56) References Cited

U.S. PATENT DOCUMENTS 5,570,164 A * 10/1996 Yamamoto ..... G03G 15/0815 15/256.51
6,272,302 B1 * 8/2001 Yamamoto ..... G03G 15/0815 399/150
2007/0292165 A1 * 12/2007 Hirayama ..... G03G 15/0815 399/267
2008/0181675 A1 * 7/2008 Fujishima ..... G03G 15/0815 399/267
2016/0091826 A1 * 3/2016 Furukawa ..... G03G 15/0907 399/273

FOREIGN PATENT DOCUMENTS

JP 2013-142740 A 7/2013

* cited by examiner

*Primary Examiner* — G. M. A Hyder
(74) *Attorney, Agent, or Firm* — Squire Patton Boggs (US)LLP

(57) ABSTRACT

An image forming apparatus includes the following. An image carrier forms an electrostatic latent image by exposure. A developing apparatus stores a developing agent including toner and which develops the image carrier. A collector collects in the developing apparatus the developing agent scattered from the developing apparatus. An input unit is used by a user to select a screen type relating to a fineness of a halftone image. An adjuster is able to change strength of an electric field between the collector and the image carrier. A hardware processor which controls the adjuster to change the strength of the electric field according to the selected screen type.

9 Claims, 8 Drawing Sheets

IMAGE FORMING APPARATUS, IMAGE FORMING METHOD, AND STORAGE MEDIUM

BACKGROUND

1. Technological Field

The present invention relates to an image forming apparatus, an image forming method, and a storage medium.

2. Description of the Related Art

There is a well-known image forming apparatus in which a developing roller is provided in an opening of a developing container storing a developing agent, and toner is emitted from the developing roller to the photoreceptor exposed with the image to form the toner image.

In the image forming apparatus, the toner scatters without heading toward the photoreceptor if the printed area becomes larger. By providing a collecting roller between the developing roller and the photoreceptor, the scattered toner is attached and scraped with a scraper to be collected in the developing container. With this, it is possible to prevent the toner scattering in the image forming apparatus from between the developing roller and the photoreceptor.

When excess toner is attached to the surface of the collecting roller while the scattered toner is being collected, the toner may aggregate before scraping with the scraper, and the aggregated toner may fall outside of the developing container.

Therefore, the image forming apparatus according to Japanese Patent Application Laid-Open Publication No. 2013-142740 is provided with a humidity detector which detects the humidity in the apparatus. A collecting roller bias is applied depending on the detected humidity in order to control the surface potential.

When the toner T attached to the collecting roller is aggregated, the aggregation Tg of the toner may be pulled toward the photoreceptor side and may attach to an exposure unit due to the electric field between the collecting roller and the photoreceptor exposure unit.

FIG. 10A to FIG. 10C show the potential when a solid toner image is formed on the photoreceptor and the change in the position of the aggregation Tg of the toner. FIG. 11A to FIG. 11C shows the potential when a halftone toner image is formed on the photoreceptor and the change in the position of the aggregation Tg of the toner. In FIG. 10A to FIG. 10C and FIG. 11A to FIG. 11C, reference G shows a potential of the developing roller, reference S shows a potential of the collecting roller, reference K shows a potential of the exposing unit which is a halftone dot of the photoreceptor, and reference W shows a potential of a non-exposing unit between the halftone dots. The toner T is charged to minus, and the anode potential is higher to the upper side of FIG. 10A to FIG. 10C and FIG. 11A to FIG. 11C.

As shown in FIG. 12A, even if the aggregation Tg of the toner T is attached to the exposing unit of the photoreceptor when the solid image is formed, the toner T with the same color as the background is attached. Therefore, this does not stand out and does not have influence on the image quality. In FIG. 12A and FIG. 12B, for the purpose of description, the toner T suitably attached and the toner Tk scattered from the aggregation attached to the collecting roller are shown with different designs, but actually, both the toner T and the toner Tk are the same color.

When the aggregation Tg of the toner T is attached to the exposing unit of the photoreceptor when the halftone image is formed, as shown in FIG. 12B, the toner Tk scattered from the aggregation is attached to the base portion around the halftone dot where toner T should not be attached. Therefore, there is a possibility that the image quality may decrease.

The conventional image forming apparatuses could not cope with the decrease in image quality when forming the halftone image.

SUMMARY

The object of the present invention is to enhance image quality.

To achieve at least one of the abovementioned objects, according to an aspect of the present invention, an image forming apparatus reflecting one aspect of the present invention is described, the image forming apparatus including: an image carrier which forms an electrostatic latent image by exposure; a developing apparatus which stores a developing agent including toner and which develops the image carrier; a collector which collects in the developing apparatus the developing agent scattered from the developing apparatus; an input unit with which a user selects a screen type relating to a fineness of a halftone image; an adjuster which is able to change strength of an electric field between the collector and the image carrier; and a hardware processor which controls the adjuster to change the strength of the electric field according to the selected screen type.

According to another aspect of the present invention, an image forming method used in an image forming apparatus which forms a halftone image, the apparatus including an image carrier which forms an electrostatic latent image by exposure, a developing apparatus which stores a developing agent including toner and which develops the image carrier, a collector which collects in the developing apparatus the developing agent scattered from the developing apparatus, and an adjuster which is able to change strength of an electric field between the collector and the image carrier, the method including: inputting by a user to select a screen type relating to a fineness of a halftone image; and controlling the adjuster to change the strength of the electric field according to the selected screen type.

According to another aspect of the present invention a non-transitory computer-readable storage medium having a program stored thereon for controlling a computer used in an image forming apparatus which forms a halftone image, the apparatus including an image carrier which forms an electrostatic latent image by exposure, a developing apparatus which stores a developing agent including toner and which develops the image carrier, a collector which collects in the developing apparatus the developing agent scattered from the developing apparatus, and an adjuster which is able to change strength of an electric field between the collector and the image carrier, wherein the program controls the computer to: control the adjuster to change the strength of the electric field according to the screen type selected on an inputter on which a user selects a screen type relating to a fineness of a halftone image.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

[Schematic Configuration of Image Forming Apparatus]

Figure 1:
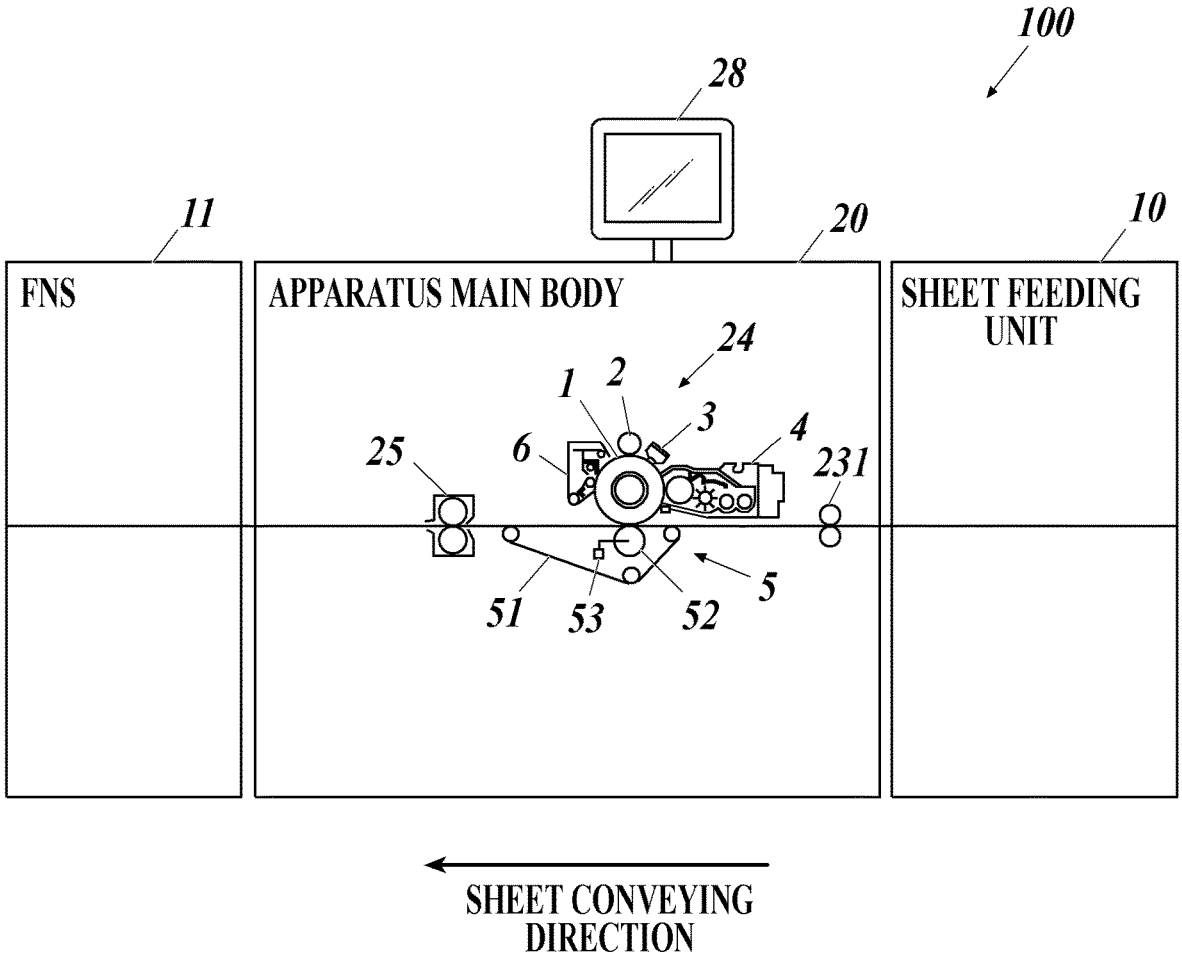
FIG. 1 is an overall view showing a schematic configuration of an image forming apparatus according to the present embodiment.

FIG. 1 is an overall diagram showing a schematic configuration of an image forming apparatus 100 according to the present embodiment.

As shown in FIG. 1, the image forming apparatus 100 includes a sheet feeding unit 10, an apparatus main body 20 and a FNS (post processing unit) 11 connected in a series along a sheet conveying direction.

Instead of providing the sheet feeding unit 10 and the FNS 11 in the image forming apparatus 100, the sheet feeder may be provided in the apparatus main body 20. According to the present embodiment, the apparatus main body 20 is described as an image forming apparatus which forms a monochrome image, but the apparatus main body 20 is not limited to the above. For example, the apparatus main body 20 may be an image forming apparatus which forms a color image including the four colors of cyan (C), magenta (M), yellow (Y) and black (K).

The sheet feeding unit 10 is a paper feed unit (PFU) and is provided with a plurality of sheet feeding trays, and a sheet feeder including sheet feeding rollers, separating rollers, sheet feeding/separating rubber, sending rollers, and the like. Each sheet feeding tray stores sheets according to type (sheet type, basis weight, sheet size), and the sheet feeder feeds the sheet one sheet at a time from the top sheet and conveys the sheet to the apparatus main body 20.

The apparatus main body 20 forms the image on the sheet based on a PDL format (Page Description Language) received from external apparatuses, etc., or a print data and print setting data (print job) in a page description language format such as Tiff format, etc. The sheet on which the image is formed is conveyed to the FNS 11. The apparatus main body 20 may be provided with a scanner, and the image may be formed on the sheet based on the image data read from the document by the scanner.

The FNS 11 is provided with various post processors such as a sorter, a stapler, a puncher, a folder, etc. and a sheet ejecting tray. Various post-processes are performed on the sheet conveyed from the apparatus main body 20 and the sheet on which the post process is performed is ejected to the ejecting tray.

[Apparatus Main Body]

Figure 2:
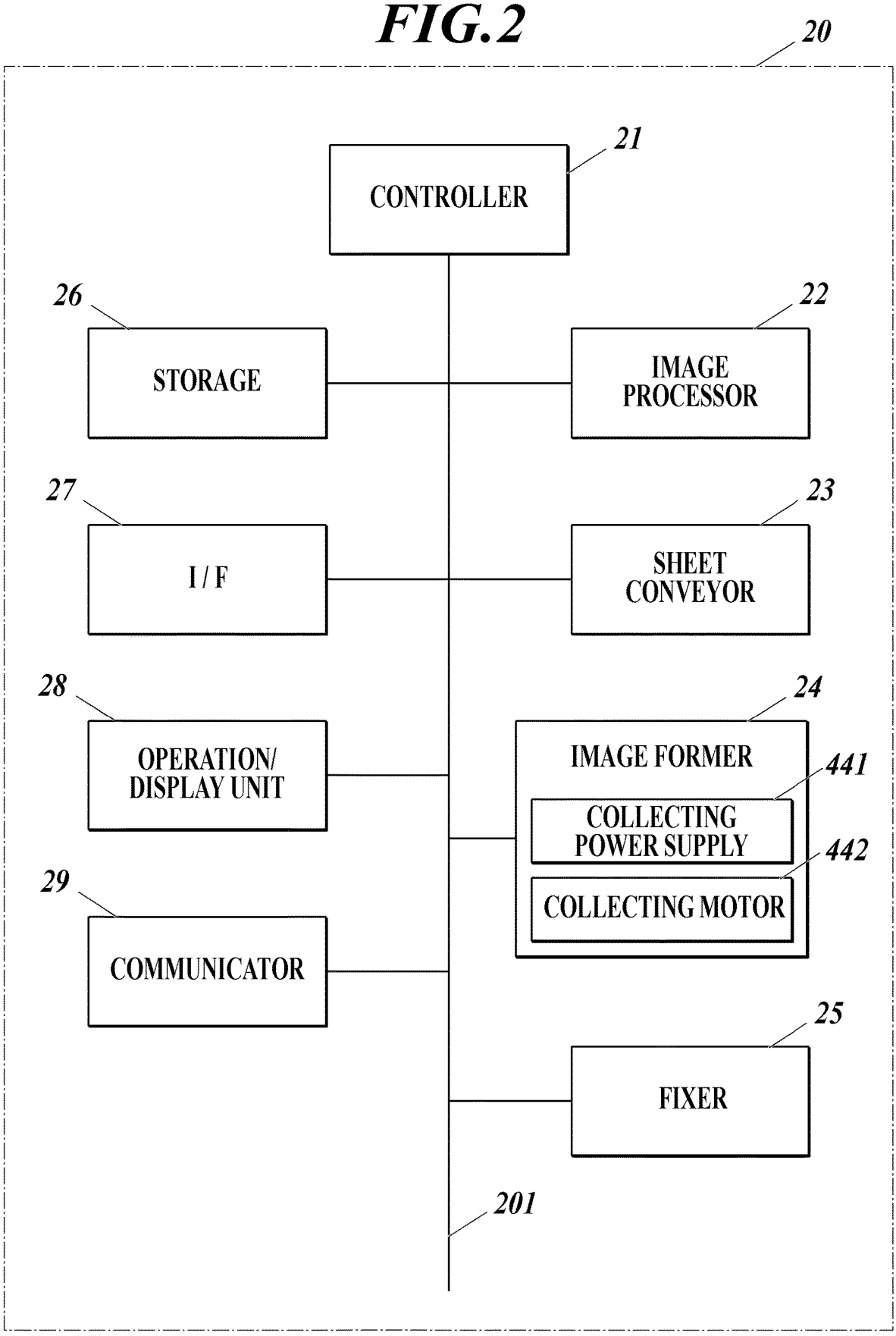
FIG. 2 is a block diagram showing a functional configuration of an apparatus main body.

FIG. 2 is a block diagram showing a functional configuration of the apparatus main body 20.

The apparatus main body 20 includes a controller 21, an image processor 22, a sheet conveyor 23, an image former 24, a fixer 25, a storage 26, an I/F 27, an operation/display unit 28, and a communicator 29. Each unit is connected by a bus 201.

The controller 21 includes a Central Processing Unit (CPU), a Random Access Memory (RAM), and a Read Only Memory (ROM), etc. The CPU of the controller 21 reads out the system program and various process programs stored in the ROM and deploys the program in the RAM. The CPU of the controller 21 performs various processes according to the deployed program. The CPU of the controller 21 functions as the computer which centrally controls the operation of each unit of the apparatus main body 20 and the entire image forming apparatus 100.

For example, when the print job is received from the external apparatus, the controller 21 starts the job, and controls the image processor 22 to perform the image processes on the image data. Then, the controller 21 controls the sheet conveyor 23, the image former 24, and the fixer 25 to form the image on the sheet based on the image data on which the image process is performed. The controller 21 sends out the sheet on which the image is formed and fixed to the FNS 11.

The controller 21 performs characteristic control regarding the collecting of toner in the developing apparatus 4 of the image former 24. The toner collecting control is described later.

The image processor 22 performs a rasterizing process on print data transmitted from an external apparatus through the communicator 29 to generate image data, and performs various image processes on the image data such as a color conversion process, a tone correction process, and a halftone process.

The sheet conveyor 23 includes a plurality of conveying rollers such as a registration roller 231 and conveying belts. The sheet conveyor 23 conveys the sheet conveyed from the sheet feeding unit 10 to the image former 24. The sheet conveyor 23 conveys the sheet on which the image is formed by the image former 24 to the fixer 25. For example, various sensors (not shown) such as a registration sensor, a jam detection sensor, and a density detection sensor are provided on a conveying path of the sheet. Each sensor is connected to the controller 21 and the detection signal is output to the controller 21.

The image former 24 includes a photoreceptor drum 1 as an image carrier, a charger 2, an exposing unit (laser light source, polygon mirror) 3, a developing apparatus 4, a transfer unit 5, and a cleaner 6. The image former 24 exposes light by the exposing unit 3 on the surface of the rotating photoreceptor drum 1 charged uniformly by the charger 2 to form an electrostatic latent image corresponding to the image data on the surface of the photoreceptor drum 1. The image former 24 reversely develops the electrostatic latent image with the developing apparatus 4 and forms a black toner image on the photoreceptor drum 1. Then, the image former 24 uses the registration roller 231 to synchronize the position of the fed sheet with the position of the toner image formed on the photoreceptor drum 1 and sends the sheet to the transfer unit 5. The toner image formed on the surface of the photoreceptor drum 1 is transferred by the transfer unit 5 to the sheet charged in the polarity opposite of the toner. With this, the image is formed on the sheet. The toner remaining in the photoreceptor drum 1 is removed by the cleaner 6.

Here, the developing apparatus 4 is described with reference to FIG. 3 and FIG. 4.

The developing apparatus 4 includes a developing container 41 including a developing agent including toner and a carrier. The developing container 41 is open to the photoreceptor drum 1. A stirring screw 42 which stirs the developing agent and which conveys the opening is provided in the inside of the developing container 41. A developing roller 43 positioned near the outer circumference of the photoreceptor drum 1 is provided in the opening of the developing container 41. In this developing apparatus 4, the toner is charged to minus Therefore, minus bias voltage is applied to the developing roller 43, the exposed portion of the photoreceptor drum 1 becomes a high potential, an electric field occurs from the exposed portion of the photoreceptor drum 1 to the developing roller 43 side with the low electric potential, and the minus toner can be sent to the exposed portion side of the photoreceptor drum 1.

Figure 3:
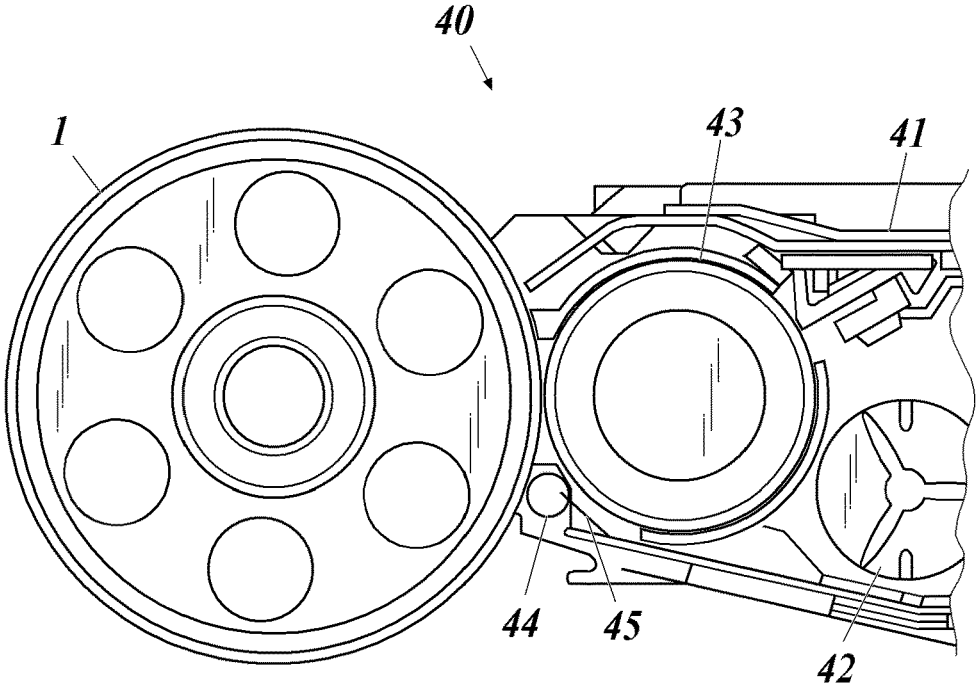
FIG. 3 is a side view showing a developing apparatus.
Figure 4:
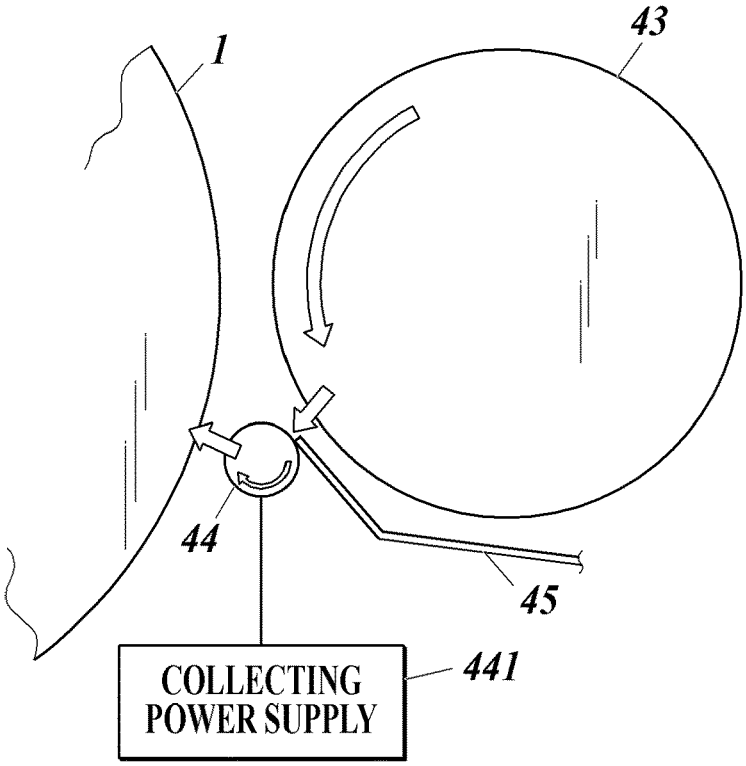
FIG. 4 is a partial enlarged view of FIG. 3.

In FIG. 3 and FIG. 4, the developing roller 43 of the developing apparatus 4 is driven in a counter clockwise direction by a motor which is not shown. A collecting roller 44 as the rotating member is provided near the developing roller 43 on the downstream side from the photoreceptor drum 1 in the rotating direction of the developing roller 43.

As shown in FIG. 4, a collecting power supply 441 which applies a minus bias voltage with a higher potential than the developing roller 43 is connected to the collecting roller 44. Therefore, the toner which scattered without going from the developing roller 43 to the photoreceptor drum 1 side can be pulled to the outer circumferential surface of the collecting roller 44 and collected. The voltage applied by the collecting power supply 441 is controlled by the controller 21.

Regarding the photoreceptor drum 1, the developing roller 43, and the collecting roller 44, the order from the unit with high voltage to the minus side is as follows.

Exposing unit of the photoreceptor drum 1<collecting roller 44<developing roller 43<non-exposing unit of the photoreceptor drum 1.

The collecting roller 44 is driven to rotate in the clockwise direction in FIG. 3 and FIG. 4, by the collecting motor 442 (see FIG. 2) which is a driving source independent from the developing roller 43. The rotating speed by the collecting motor 442 is controlled by the controller 21.

A scraper 45 which slides against the outer circumferential surface of the collecting roller 44 is provided between the collecting roller 44 and the developing roller 43. The scraper 45 is able to scrape the toner attached to the collecting roller 44 and is able to send the toner into the developing container 41.

The transfer unit 5 includes a transfer belt 51, and a transfer roller (transfer member) 52. For example, the transfer belt 51 is a belt in which a surface of a base including chloroprene rubber including a conducting agent is processed with PTFE (polytetrafluoroethylene) as a coating layer.

By using the voltage applying unit 53, the toner image on the photoreceptor drum 1 is transferred on the sheet in contact with the photoreceptor drum 1 by the electrostatic attraction. As described above, the charged polarity of the toner is minus, and a positive transfer voltage is applied to the transfer roller 52 when the toner image is transferred on the sheet.

The fixer 25 performs a fixing process in which the sheet on which the toner image is transferred is heated and pressured to fix the toner on the sheet.

The storage 26 includes a dynamic random access memory (DRAM) and stores a print job input through the communicator 29 or image data on which the image process is performed. Such image data can be stored in the RAM of the controller 21.

The I/F 27 is a communication interface to connect to the sheet feeding unit 10 and the FNS 11.

The operation/display unit 28 includes a liquid crystal display (LCD), and displays various operation buttons, state of the apparatus, and operation state of various functions on the display screen according to the instruction of the display signal input from the controller 21.

The display screen of the LCD is covered with a pressure sensitive (resistance film pressure) touch panel in which transparent electrodes are positioned in a lattice shape. The XY coordinates of a pressure point pressed with fingers or a touch pen are detected by a voltage value and the detected position signal is output to the controller 21 as the operation signal.

The user is able to select and set on the operation/display unit 28 the screen line number as the screen type showing the fineness of the image in the halftone process performed by the image processor 22. That is, the operation/display unit 28 functions as the inputter.

The communicator 29 includes a modem, a LAN adaptor, and a router. The communicator controls communication with the external apparatus such as a Personal Computer (PC) connected to the communication network such as the LAN (Local Area Network), WAN (Wide Area Network), etc., and receives the print job, etc.

[Toner Collecting Control]

The control for collecting toner in the developing apparatus 4 controlled by the controller 21 of the image forming apparatus 100 is described.

The problem in the collecting operation of the scattered toner by the collecting roller 44 is that the aggregation of the toner attached to the outer circumferential surface of the collecting roller 44 is pulled by the electric field between the collecting roller 44 and the exposing unit of the photoreceptor drum 1. As a result, the toner falls and attaches to the surroundings of the exposing unit of the photoreceptor drum 1.

When the image is formed in halftone, the toner is attached to the surroundings of the halftone dot where toner is not supposed to be attached. The toner from the collecting roller 44 attaching tends to influence the image quality.

As described above, according to the image forming apparatus 100, the screen line number can be set on the operation/display unit 28. The screen line number is the value as the index of the fineness of the image showing the number of lines formed with the aligned dots (halftone dot) forming the halftone image for each unit distance (for example, 1 inch). The unit is shown as for example [lpi] (line per inch). As the screen line number becomes larger, the fineness of the formed image becomes greater.

Figure 5:
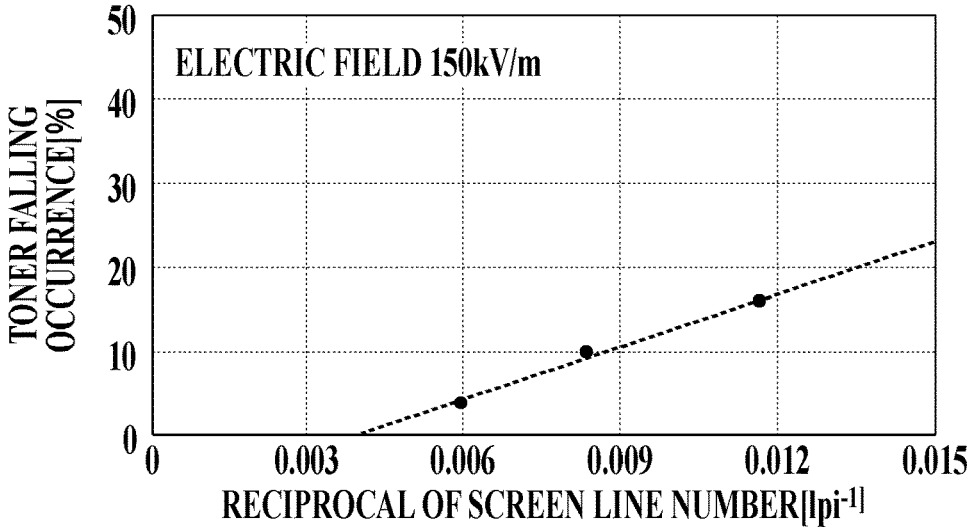
FIG. 5 is a diagram showing a relation between a reciprocal of the screen line number and the rate of occurrence of toner falling.

There is a relation between the screen line number showing the fineness of the image and the occurrence rate of the toner falling. FIG. 5 is a diagram showing a relation between the reciprocal of the screen line number [$lpi^{-1}$] and the occurrence rate [%] of the toner falling. In this case, the electric field between the collecting roller 44 and the photoreceptor drum 1 is 150 [kV/m].

As illustrated in the drawings, the larger the reciprocal of the screen line number becomes (the screen line number becomes smaller), the occurrence rate of the toner falling increases proportionally.

Figure 6:
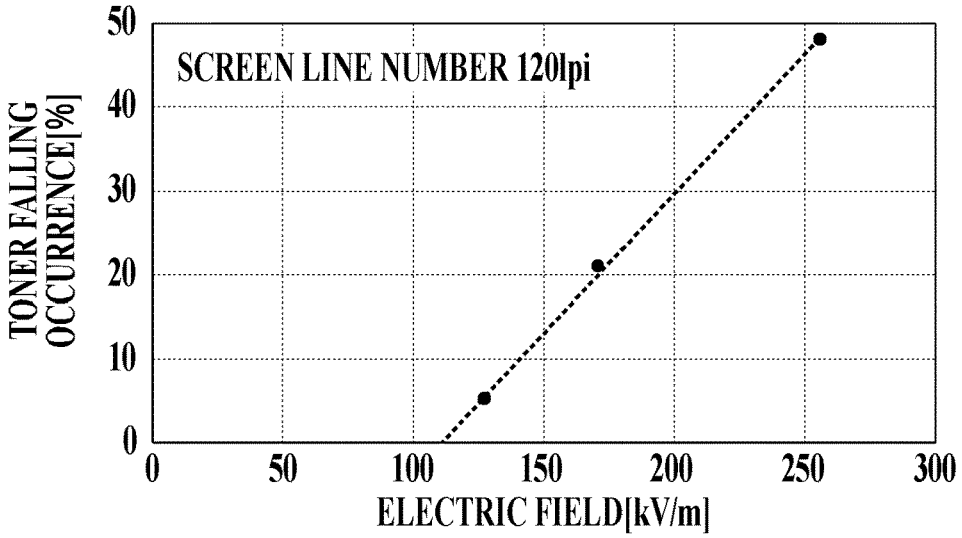
FIG. 6 is a diagram showing a relation between the rate of occurrence of the toner falling and the electric field between the collecting roller and the photoreceptor drum.

Moreover, there is a relation between the occurrence rate of the toner falling and the electric field between the collecting roller 44 and the photoreceptor drum 1. FIG. 6 is a diagram showing a relation between the occurrence rate [%] of the toner falling and the electric field [kV/m] between the collecting roller 44 and the photoreceptor drum 1. In this case, the screen line number when the image is formed is 120 [lpi].

As illustrated in the drawings, as the electric field between the collecting roller and the photoreceptor drum 1 becomes larger, the occurrence rate of the toner falling increases proportionally.

Figure 7:
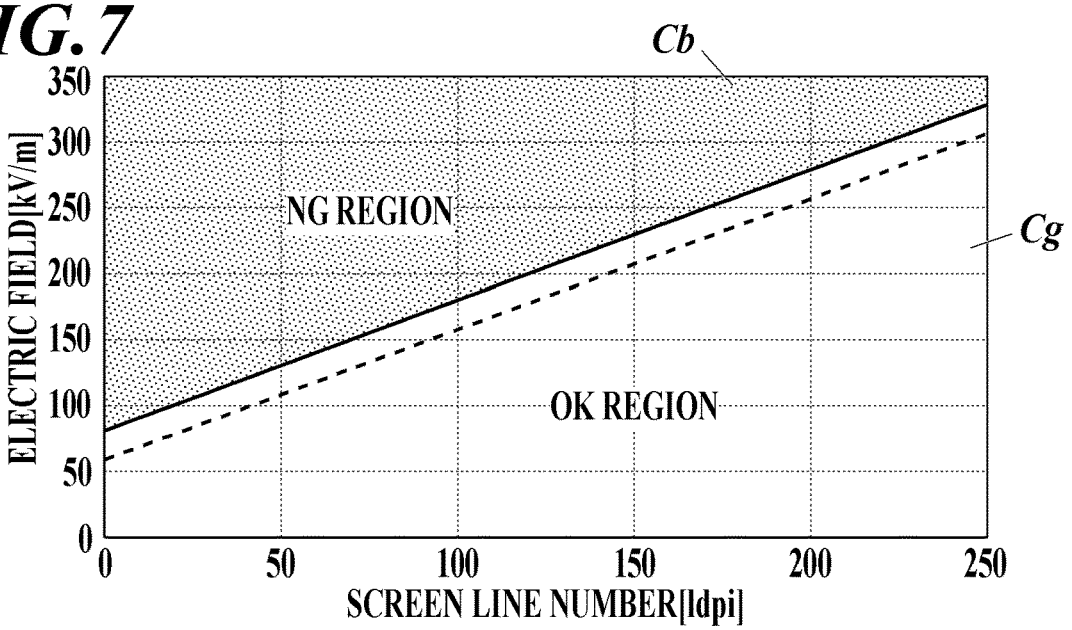
FIG. 7 is a diagram showing a relation between the screen line number, and the electric field between the collecting roller and the photoreceptor drum.

When the acceptable value of the occurrence rate of the toner falling is determined to be a certain value or less from the relation shown in FIG. 5 and FIG. 6, the relation between the screen line number and the electric field between the collecting roller 44 and the photoreceptor drum 1 (electric field-screen line number characteristic) is as shown in FIG. 7. In FIG. 7, a horizontal axis is to be the screen line number [lpi], and a vertical axis is to be the electric field [kV/m] between the collecting roller 44 and the photoreceptor drum 1. In FIG. 7, the range Cg in which the occurrence rate of the toner falling is a predetermined acceptance value or less is shown without a design, and the range Cb which does not satisfy the acceptance value is shown with a design using points.

The values shown in FIG. 5 to FIG. 7 merely show one example and the values to be used are not limited to these examples. The suitable value of these values change according to various conditions such as the positions of the developing roller 43 and the collecting roller 44, and the voltage applied to the above, the surface material of the above, the characteristics of the toner and the like. Therefore, preferably, a suitable value is obtained for each of the various image forming apparatuses.

The controller 21 of the image forming apparatus 100 stores the electric field-screen line number characteristic shown in FIG. 7, for example, the boundary between the range Cg which is equal to or below the acceptance value and the range Cb which does not satisfy the acceptance value as data including values or equations.

Then, when the user sets the screen line number on the operation/display unit 28, the controller 21 controls the value of the electric field between the collecting roller 44 and the photoreceptor drum 1 so that the value is within the above-described range Cg which is equal to or below the acceptance value.

The value of the electric field E[kV/m] between the collecting roller 44 and the photoreceptor drum 1 can be calculated by the following equation (1) with the following setting, the distance between the collecting roller 44 and the photoreceptor drum 1 (shortest distance between each other's outer circumferential surface) as d[m], the surface potential of the collecting roller 44 when the non-exposure region throughout the entire longitudinal direction in the outer circumferential surface of the photoreceptor drum 1 passes near the collecting roller 44 as Vcr [kV], and the surface potential of the exposing unit of the photoreceptor drum 1 as Vi [kV].

$$E=-(Vcr-Vi)/d \quad (1)$$

Therefore, the controller 21 of the image forming apparatus 100 controls the collecting power supply 441 as the adjuster to adjust the surface potential Vcr [kV] of the collecting roller 44 so that the value of the electric field E between the collecting roller 44 and the photoreceptor drum 1 is the suitable value shown in the electric field-screen line number characteristic shown in FIG. 7 according to the set value of the screen line number.

The surface potential Vi of the exposing unit of the photoreceptor drum 1 is determined according to the strength and the irradiating time of the exposing unit 3 which performs exposure. Therefore, the value is usually a certain value. Consequently, the surface potential Vi is obtained by measurement in advance.

When the value of the electric field E [kV/m] between the collecting roller 44 and the photoreceptor drum 1 is adjusted to be drastically lower than the value in the boundary between the range Cg which is equal to or lower than the acceptance value and the range Cb which does not satisfy the acceptance value, the electric field between the developing roller 43 and the collecting roller 44 becomes large, and the scattering of the toner from the developing roller 43 to the collecting roller 44 easily occurs. Therefore, the surface potential Vcr of the collecting roller 44 is adjusted so that the electric field E is a value within a certain range lower than the boundary value (for example, value between boundary line in the electric field-screen line characteristic and the broken line as shown in FIG. 7).

With this, the occurrence rate of the toner falling can be reduced to lower than the acceptance value.

When the controller 21 of the image forming apparatus 100 controls the value of the electric field E between the collecting roller 44 and the photoreceptor drum 1 to the suitable value shown in FIG. 7 according to the setting value of the screen line number, if the value of the electric field E becomes equal to or lower than a determining value Es set in advance, the controller 21 controls the rotating speed of the collecting motor 442 driving the collecting roller 44 so as to be a high operating speed faster than the normal operating speed.

When the value of the electric field E between the collecting roller 44 and the photoreceptor drum 1 becomes small, the value of the electric field between the collecting roller 44 and the developing roller 43 becomes large. Therefore, the toner scattering from the developing roller 43 to the collecting roller 44 easily occurs. In view of the above, the controller 21 controls the collecting roller 44 to increase the rotating speed so that the scraper 45 is able to scrape off the toner attached to the collecting roller 44 quickly and effectively.

Figure 8:
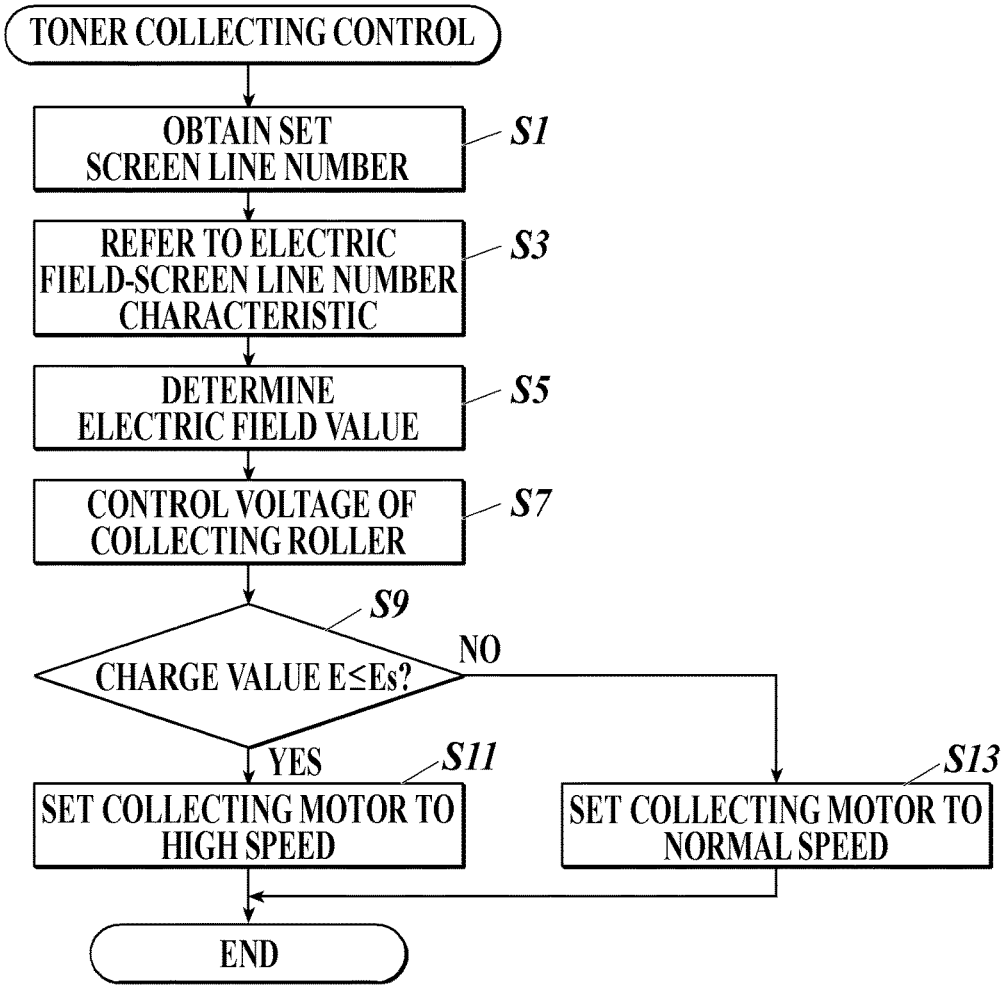
FIG. 8 is a flowchart showing the toner collecting control performed when the image is formed.

FIG. 8 is a flowchart showing the CPU of the controller 21 in the image forming apparatus 100 controlling the collection of toner performed when the image is formed according to the control program stored in the ROM.

In the control of collecting toner, the CPU of the controller 21 obtains the setting value of the screen line number set by the user in the input process (step S1), refers to the electric field-screen line number characteristic shown in FIG. 7 (step S3), and determines the suitable value of the electric field E between the collecting roller 44 and the photoreceptor drum 1 (step S5).

Then, the CPU of the controller 21 controls the collecting power supply 441 of the collecting roller 44 and adjusts the electric field E between the collecting roller 44 and the photoreceptor drum 1 as the suitable value (step S7: control process).

The CPU of the controller 21 determines whether the determined suitable value of the electric field E is equal to or lower than a determining value Es (step S9).

As a result, if the suitable value of the electric field E is equal to or lower than the determining value Es, the collecting motor 442 of the collecting roller 44 is driven at a high operating speed (step S11), and if the suitable value of the electric field E is higher than the determining value Es, the collecting motor 442 of the collecting roller 44 is driven at a normal operating speed (step S13).

Then, the control of collecting toner ends, and the image is formed.

Effect of Embodiment

As described above, in response to the selection of the screen line number as the screen type, the controller 21 in the image forming apparatus 100 controls the collecting power supply 441 as the adjuster to change the strength of the electric field. Therefore, it is possible to reduce the toner attaching to the surrounding of the halftone dot when the halftone image is made. Consequently, the quality of the image is enhanced.

Since the collecting power supply 441 which changes the degree of the voltage applied to the collecting roller 44 functions as the adjuster, the electric field can be controlled easily and accurately.

The controller 21 controls the collecting power supply 441 to change the electric field to be stronger when the fineness of the image shown by the selected screen line number becomes higher, and to change the electric field to be weaker when the fineness of the image shown by the selected screen line number becomes lower.

With this, the toner attaching can be effectively reduced and the quality of the image is enhanced for the image with the low fineness in which the influence of the toner attaching tends to occur.

The controller 21 controls the collecting motor 442 to increase the rotating speed of the collecting roller 44 in response to the weakness of the electric field. Therefore, it is possible to use the scraper to quickly and efficiently remove the toner attached to the collecting roller 44 which increases by making the electric field weaker. With this, the toner attaching to the photoreceptor drum 1 can be reduced and the image quality is enhanced.

[Verification Experiment]

The verification experiment performed to confirm the effectiveness of the present invention is described below.

In the verification experiment, an image forming apparatus remodeling the Accurio PRESS 6136 of Konica Minolta is used. That is, the screen type which can be set is to be the screen line number. A roller type (collecting roller) is used as the collector.

The determination value of the electric field is set to Es=50 [kV/m], the normal operating speed of the collecting roller 44 is set to 4 [rpm], and the high operating speed is set to 10 [rpm].

In the verification experiment, examples 1 to 4 which are to be suitable in the electric field screen line number characteristic and comparative examples 1 to 3 which are not suitable are used with new and unused developing apparatus 4 and photoreceptor drum 1. As the printing pattern, an image is formed at 20% density on the entire surface on 10000 surfaces of A3 sized sheet.

As an evaluation method, for each surface of the sheet, when there is even one fallen toner with ϕ0.5 [mm] or more, this is counted as toner falling occurring, and when the percentage of the number of surfaces in which the toner falling occurred among the 10000 surfaces is 0.5% or less, the evaluation is to be good, and when the percentage passes 0.5%, the evaluation is to be bad.

Example 1

The screen line number 120 [lpi] is selected.

The collecting roller is set to surface voltage Vcr=−0.300 [kV], the exposing unit of the photoreceptor drum is set to surface voltage Vi=−0.284 [kV], the collecting roller diameter is set to ϕ8 [mm], and the distance between the collecting roller and the photoreceptor drum is to be d=0.0005 [m]. With this, the electric field is to be E=32 [kV/m], and the rotating speed of the collecting roller is to be 10 [rpm].

Example 2

The screen line number 170 [lpi] is selected.

The collecting roller is set to surface voltage Vcr=−0.300 [kV], the exposing unit of the photoreceptor drum is set to surface voltage Vi=−0.211 [kV], the collecting roller diameter is set to ϕ8 [mm], and the distance between the collecting roller and the photoreceptor drum is to be d=0.0005 [m]. With this, the electric field is to be E=178 [kV/m], and the rotating speed of the collecting roller is to be 4 [rpm].

Example 3

The screen line number 80 [lpi] is selected.

The collecting roller is set to surface voltage Vcr=−0.300 [kV], the exposing unit of the photoreceptor drum is set to surface voltage Vi=−0.211 [kV], the collecting roller diameter is set to ϕ6 [mm], and the distance between the collecting roller and the photoreceptor drum is to be d=0.0015 [m]. With this, the electric field is to be E=59.3 [kV/m], and the rotating speed of the collecting roller is to be 4 [rpm].

Example 4

The apparatus has the same configuration as Example 1, but the apparatus is remodeled so that the applied voltage to the collecting roller can be controlled in response to the selected screen line number (L[lpi]).

The screen line number L 150 [lpi] is selected.

The collecting roller is set to surface voltage Vcr=−0.001×L−0.2=−0.35 [kV], the exposing unit of the photoreceptor drum is set to surface voltage Vi=−0.284 [kV], the collecting roller diameter is set to ϕ6 [mm], and the distance between the collecting roller and the photoreceptor drum is to be d=0.0005 [m]. With this, the electric field is to be E=59.3 [kV/m], and the rotating speed of the collecting roller is to be 4 [rpm].

Comparative Example 1

The screen line number 120 [lpi] is selected.

The collecting roller is set to surface voltage Vcr=−0.350 [kV], the exposing unit of the photoreceptor drum is set to surface voltage Vi=−0.211 [kV], the collecting roller diameter is set to ϕ8 [mm], and the distance between the collecting roller and the photoreceptor drum is to be d=0.0005 [m]. With this, the electric field is to be E=278 [kV/m], and the rotating speed of the collecting roller is to be 4 [rpm].

Comparative Example 2

The screen line number 170 [lpi] is selected.

The collecting roller is set to surface voltage Vcr=−0.300 [kV], the exposing unit of the photoreceptor drum is set to surface voltage Vi=−0.164 [kV], the collecting roller diameter is set to ϕ8 [mm], and the distance between the collecting roller and the photoreceptor drum is to be d=0.0005 [m]. With this, the electric field is to be E=272 [kV/m], and the rotating speed of the collecting roller is to be 4 [rpm].

Comparative Example 3

The screen line number 80 [lpi] is selected.

The collecting roller is set to surface voltage Vcr=−0.300 [kV], the exposing unit of the photoreceptor drum is set to surface voltage Vi=−0.211 [kV], the collecting roller diameter is set to ϕ8 [mm], and the distance between the collecting roller and the photoreceptor drum is to be d=0.0005 [m]. With this, the electric field is to be E=178 [kV/m], and the rotating speed of the collecting roller is to be 4 [rpm].

The result of the verification experiment showed good for all of the examples 1 to 4 in which the electric field-screen line number characteristic is suitable. On the other hand, the result showed bad for all of the comparative examples 1 to 3 in which the electric field-screen line number characteristic is unsuitable.

[Others]

The embodiments described above are merely a preferable example of the present invention, and the present invention is not limited to the above-described embodiments.

The detailed configuration and detailed operation of the apparatuses included in the image forming apparatus can be suitably changed without leaving the scope of the present invention.

Figure 9:
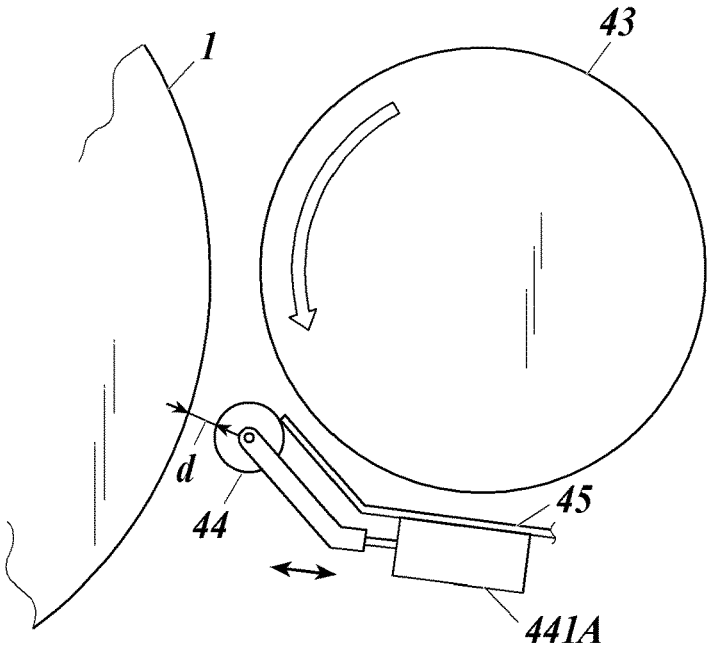
FIG. 9 is a side view showing another example of an adjuster.
Figure 10A:
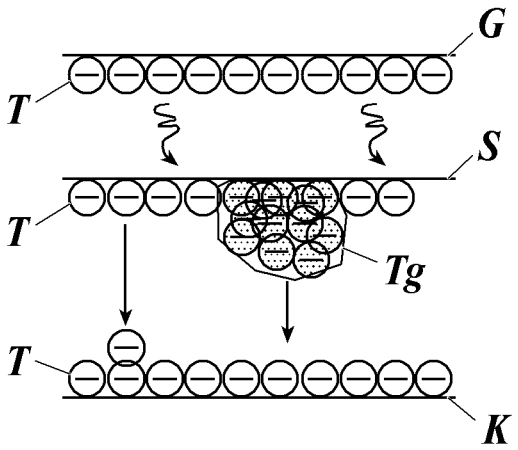
FIG. 10A is an explanatory diagram showing a potential when a solid toner image is formed on a photoreceptor and a change in position of an aggregation of toner.
Figure 10B:
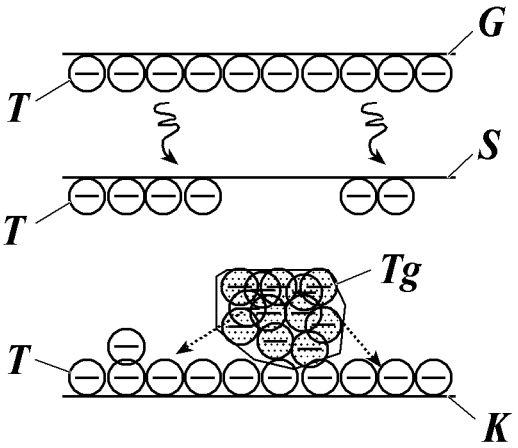
FIG. 10B is an explanatory diagram showing a potential when a solid toner image is formed on a photoreceptor and a change in position of an aggregation of toner.
Figure 10C:
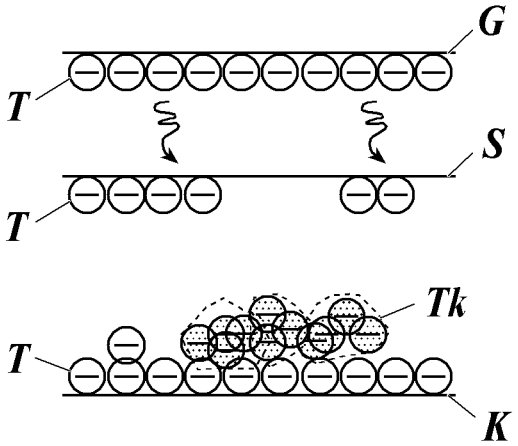
FIG. 10C is an explanatory diagram showing a potential when a solid toner image is formed on a photoreceptor and a change in position of an aggregation of toner.
Figure 11A:
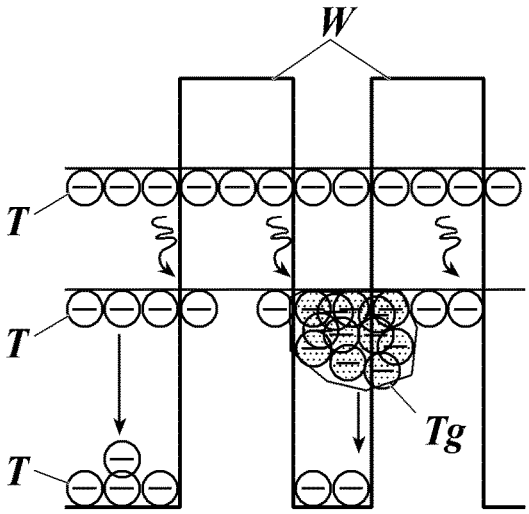
FIG. 11A is an explanatory diagram showing a potential when a halftone toner image is formed on a photoreceptor and a change in position of an aggregation of toner.
Figure 11B:
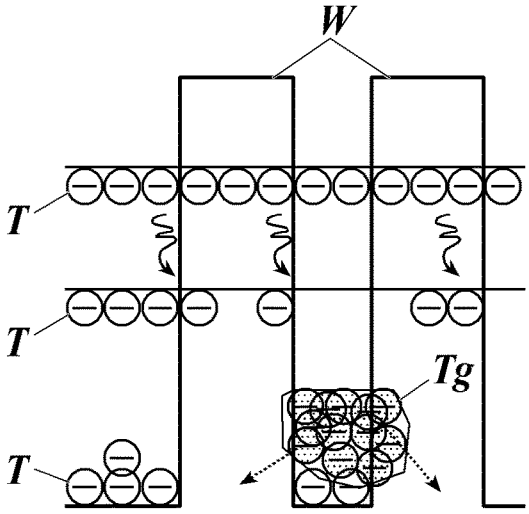
FIG. 11B is an explanatory diagram showing a potential when a halftone toner image is formed on a photoreceptor and a change in position of an aggregation of toner.
Figure 11C:
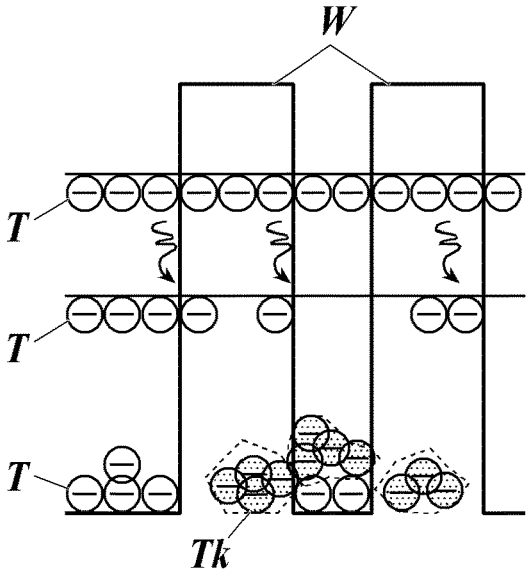
FIG. 11C is an explanatory diagram showing a potential when a halftone toner image is formed on a photoreceptor and a change in position of an aggregation of toner.
Figure 12A:
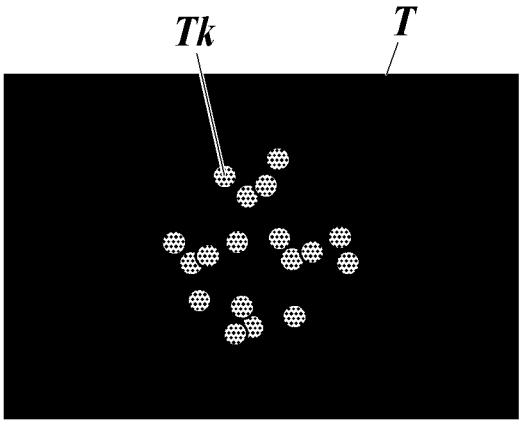
FIG. 12A is an explanatory diagram showing toner dispersed from the aggregation attached to the exposing unit of the photoreceptor when the solid image is formed.
Figure 12B:
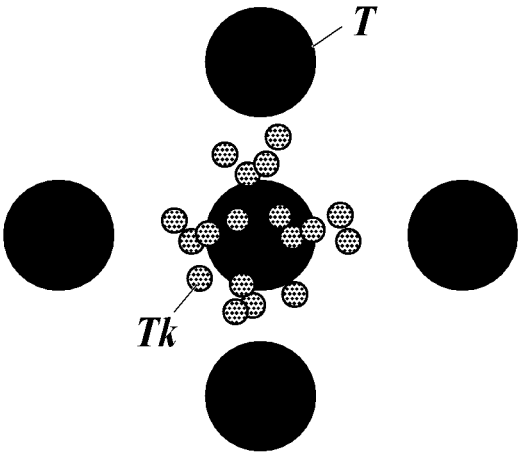
FIG. 12B is an explanatory diagram showing the aggregation of toner attached to the exposing unit when the halftone image is formed.

For example, as the adjuster which adjusts the electric field between the collecting roller 44 and the exposing unit of the photoreceptor drum 1, as shown in FIG. 9, a linear motion actuator 441A which changes the distance from the surface of the collecting roller 44 to the surface of the photoreceptor drum 1 can be employed.

In this case, the linear motion actuator 441A rotatably supports the collecting roller 44 and supports the collecting roller 44 so that the collecting roller 44 is able to come close to and separate from the photoreceptor drum 1. Preferably, the linear motion of the collecting roller 44 allows the adjustment to change the distance d between the collecting roller 44 and the photoreceptor drum 1.

The linear motion actuator 441A includes a solenoid which is able to control operation amount, a unit including a rotating motor such as a stepping motor which is able to control the rotating operation amount and the ball screw mechanism and belt mechanism which is able to change the rotating driving to the linear movement, a linear movement voice coil motor, and a piezoelectric element such as a piezo.

According to the configuration, the distance d is changed and adjusted so that the electric field between the collecting roller 44 and the exposing unit of the photoreceptor drum 1 can be adjusted freely.

As the screen type, the screen line number is shown as the example. Alternatively, the interval or the density of the dot (halftone dot) included in the halftone image can be set from the operation/display unit 28, and the controller 21 can change the strength of the electric field according to the interval or the density of the dot (halftone dot).

As the developing agent of the developing apparatus 4, the two component developing agent including the toner and the carrier is shown, but alternatively, the developing agent can be a one component developing agent not including the carrier.

The control of the collecting motor 442 of the collecting roller 44 is switched to high operating speed when the suitable value of the electric field E is equal to or smaller than the determination value Es, but the present invention is not limited to the above. For example, a plurality of determination values in different numbers can be prepared, and the rotating speed of the collecting motor 442 can be switched among a larger number of levels. The rotating speed of the collecting motor 442 can be controlled to be changed and adjusted linearly or without various levels according to the value of the electric field E.

Although embodiments of the present invention have been described and illustrated in detail, the disclosed embodiments are made for purposes of illustration and example only and not limitation. The scope of the present invention should be interpreted by terms of the appended claims.

The entire disclosure of Japanese Patent Application No. 2018-138097 filed on Jul. 24, 2018 is incorporated herein by reference in its entirety.

What is claimed is:

1. An image forming apparatus comprising:

an image carrier which forms an electrostatic latent image by exposure;

a developing apparatus which stores a developing agent including toner and which develops the image carrier;

a collector which collects in the developing apparatus the developing agent scattered from the developing apparatus;

an input unit with which a user selects a screen type relating to a fineness of a halftone image;

an adjuster which is able to change strength of an electric field between the collector and the image carrier; and a hardware processor which controls the adjuster to change the strength of the electric field according to the selected screen type.

2. The image forming apparatus according to claim 1, wherein the screen type is a screen line number showing a number of lines formed by dots included in the halftone image within a unit of a certain distance.

3. The image forming apparatus according to claim 1, wherein the screen type is an interval or a density of a dot included in the halftone image.

4. The image forming apparatus according to claim 1, wherein the adjuster changes a degree of a voltage applied to the collector to change the strength of the electric field.

5. The image forming apparatus according to claim 1, wherein the adjuster changes a distance from a surface of the collector to a surface of the image carrier to change the strength of the electric field.

6. The image forming apparatus according to claim 1, wherein the hardware processor controls the adjuster to change the electric field to be stronger when a fineness of the image shown by the selected screen type is high, and to change the electric field to be weaker when a fineness of the image shown by the selected screen type is low.

7. The image forming apparatus according to claim 1, wherein, the collector is a collecting roller which collects the developing agent by rotation;

the collector includes a collecting motor which applies a rotating operation on the collecting roller; and the hardware processor controls the rotating motor to increase a rotating speed of the collecting roller according to a weakness of the electric field.

8. An image forming method used in an image forming apparatus which forms a halftone image, the apparatus including an image carrier which forms an electrostatic latent image by exposure, a developing apparatus which stores a developing agent including toner and which develops the image carrier, a collector which collects in the developing apparatus the developing agent scattered from the developing apparatus, and an adjuster which is able to change strength of an electric field between the collector and the image carrier, the method comprising:

inputting by a user to select a screen type relating to a fineness of a halftone image; and controlling the adjuster to change the strength of the electric field according to the selected screen type.

9. A non-transitory computer-readable storage medium having a program stored thereon for controlling a computer used in an image forming apparatus which forms a halftone image, the apparatus including an image carrier which forms an electrostatic latent image by exposure, a developing apparatus which stores a developing agent including toner and which develops the image carrier, a collector which collects in the developing apparatus the developing agent scattered from the developing apparatus, and an adjuster which is able to change strength of an electric field between the collector and the image carrier, wherein the program controls the computer to:

control the adjuster to change the strength of the electric field according to the screen type selected on an inputter on which a user selects a screen type relating to a fineness of a halftone image.

* * * * *